United States Patent [19]

Thompson

[11] Patent Number: 4,715,307

[45] Date of Patent: Dec. 29, 1987

[54] CONCRETE MARINE FLOAT AND METHOD OF FABRICATING SAME

[75] Inventor: L. L. Thompson, Minneapolis, Minn.

[73] Assignee: Rock Dock, Inc., Minneapolis, Minn.

[21] Appl. No.: 805,198

[22] Filed: Dec. 4, 1985

Related U.S. Application Data

[63] Continuation-in-part of Ser. No. 439,752, Nov. 8, 1982, abandoned.

[51] Int. Cl.[4] ..... B63B 5/20

[52] U.S. Cl. ..... 114/65 A; 114/267; 264/256; 264/333

[58] Field of Search ..... 114/266, 267, 65 A; 405/219; 14/27; 264/228, 256, 333; 106/99; 52/309.17

[56] References Cited

U.S. PATENT DOCUMENTS

| | | | |
|---|---|---|---|
| 2,689,381 | 9/1954 | Terriere | 264/256 X |
| 3,179,076 | 4/1965 | Sheffield | 114/267 |
| 3,659,540 | 5/1972 | Toby et al. | 114/266 |
| 3,664,287 | 5/1972 | Duff | 114/65 A |
| 3,936,209 | 2/1976 | Krage | 264/333 X |
| 4,118,239 | 10/1978 | Gagin | 106/99 |
| 4,265,193 | 5/1981 | Sluys | 114/267 |

*Primary Examiner*—Sherman D. Basinger

[57] ABSTRACT

A marine float for use in conjunction with a concrete floating dock system and methods for manufacturing the same. The float consisting of a buoyant core of expanded polystyrene foam supporting a textured deck of standard aggregate concrete and surrounded by a shell of fiberglass reinforced cement. The float is fabricated as a unitary whole by pouring a layer of standard aggregate concrete in a form over a texturing mat to provide the textured deck, placing a buoyant element over the poured deck and spraying a layer of fiberglass reinforced cement around the buoyant element before any of the concrete elements has set. All concrete elements are then permitted to set to form a monolithic float.

3 Claims, 4 Drawing Figures

CONCRETE MARINE FLOAT AND METHOD OF FABRICATING SAME

CROSS-REFERENCE TO RELATED APPLICATION

This application is a continuation-in-part application of my copending application Ser. No. 439,752, filed on Nov. 8, 1982 and now abandoned.

BACKGROUND OF THE INVENTION

The present invention relates to a marine float for use in conjunction with a glass fiber reinforced concrete floating dock system wherein a plurality of floats may be attached to one another and arranged in any desired configuration, and a method of fabricating the floats.

It has been known to utilize concrete in the manufacture of marine docks. Typically, the concrete docks of the prior art consisted of a plurality of generally rectangular concrete floats which were secured to one another to achieve a desired configuration for the dock. The floats generally consisted of a rather thick poured concrete shell surrounding a buoyant element that was either hollow or constructed of some buoyant material such as expanded polystyrene (earlier floats were hollow in concrete floating docks). The methods of attaching successive floats to one another vary. Such prior art dock system are, for example, described in U.S. Pat. Nos. 4,265,193, 4,318,361 and 3,779,192.

Use of concrete enhances the durability of the docks as concrete is less suspeptible to the adverse effects of water, salinity and wave action than traditional dock materials such as wood, and provides improved strength characteristics. The poured, standard aggregate concrete used in the docks of the prior art presented certain disadvantage in that it lacked adequate flexibility which is advantageous under the conditions of alternating stress imparted by wave action and in that its bulk and weight made it difficult to store and transport such docks.

The methods typically used to manufacture the concrete docks of the prior art involved the use of a form or mold into which concrete was poured to a predetermined height. The floating or buoyant portion of the dock section was then placed in the form and concrete poured around and on top of the buoyant portion to complete the float. This method of construction had drawbacks in that the process was extremely slow and required a good deal of time for the concrete of the dock to set and is therefore costintensive. Furthermore, manufacturing cost of molds are substantial and the method of constructions is restrictive in that it does not allow any flexibility in shape, size, and buoyancy of the float without changing the molds.

SUMMARY OF THE INVENTION

The concrete float of the present invention avoids many of the problems inherent in the concrete of the prior art. It is one object of the present invention to provide a float for use in conjunction with a concrete dock system having a fiberglass reinforced concrete shell that is relatively thin, but that retains the strength and durability generally associated with the concrete docks of the prior art.

It is another object of the invention to provide a marine float for use in conjunction with concrete docks that may be produced by a method allowing for production flexibility to enable the manufacturer of said float to vary buoyancy on individual floats without necessitating a change of molds.

It is another object of the invention to provide a marine float for use in conjunction with concrete docks that has reduced weight and bulk characteristics yet retains the strength of the concrete docks of the prior art.

It is another object of the present invention to provide a marine float for use in conjunction with a concrete dock having improved stability characteristics by providing pontoons associated with the buoyant element of the float.

It is a further object of the present invention to provide a marine float for use in conjunction with a concrete dock having a textured, poured concrete deck supported by a buoyant portion of expanded polystyrene covered with a relatively thin shell of fiberglass reinforced concrete.

The improved method for manufacturing the marine float of the present invention generally comprises the steps of providing a rectangular form or mold designed to create a textured deck surface, spraying a layer of glass fiber reinforced concrete into the form to a predetermined depth, thereby forming a deck, pouring a layer of fine aggregate concrete on the sprayed layer of glass fiber reinforced concrete; placing a buoyant element upon the unset cement of the deck; and overlying a layer of fiberglass reinforced concrete; applying a layer or shell of fiberglass reinforced concrete around the buoyant element by spraying; allowing the concrete to set; and finally removing the form.

DETAILED DESCRIPTION OF THE PREFERRED EMBODIMENT

Figure 1:
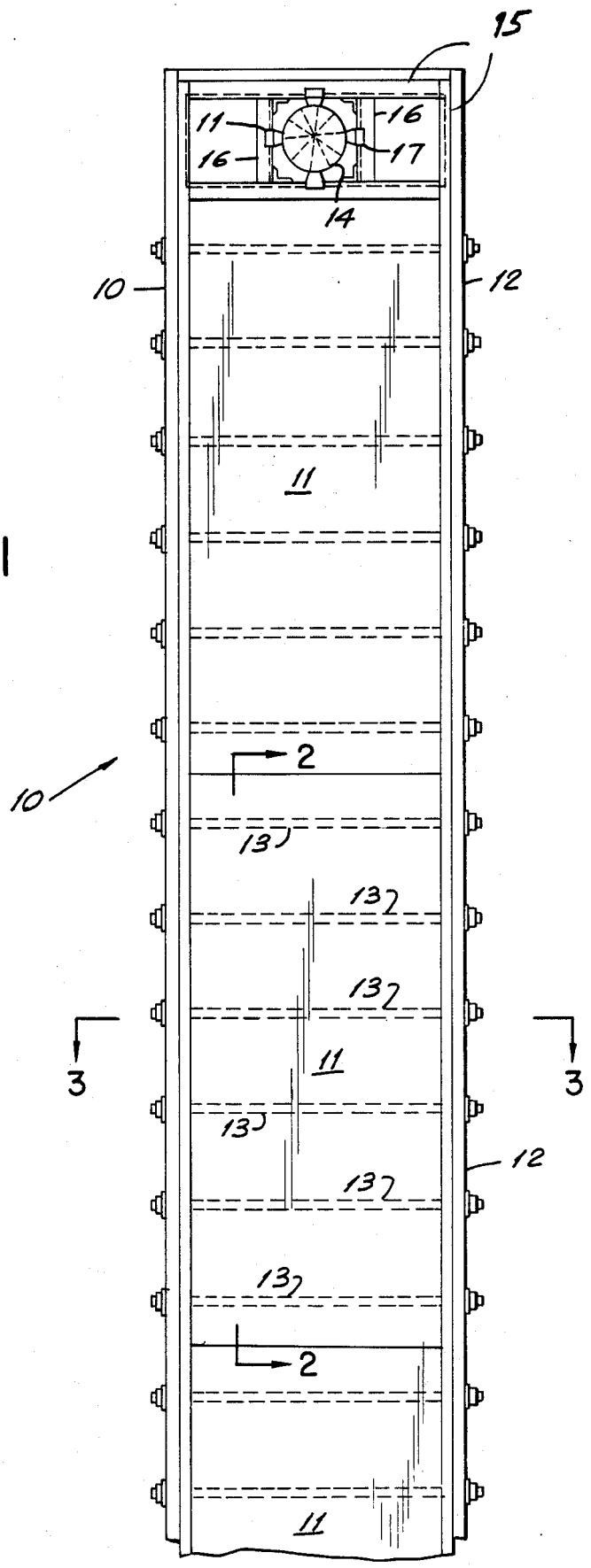
FIG. 1 is a plan view of a portion of a dock constructed of marine floats according to the present invention.

Referring to the drawing, wherein like numerals represent like elements throughout the several views, the present invention relates to a concrete marine float for use in a marine dock system wherein a plurality of floats may be detachably interconnected and secured to one another to form a dock having any desired configuration. FIG. 1 illustrates a portion of such a system. The dock 10 comprises a plurality of interconnected floats 11. The floats may be interconnected in any known fashion. In FIG. 1 successive floats are secured to one another by wooden wales 12 attached to the exterior sides of the floats 11 by means of a plurality of through-bolts 13 shown in the dashed lines. The through-bolts are threaded on one or both ends so that the wales may be secured by tightening the through-bolts with threadably mounted nuts to hold the wales 12 securely against the floats 11. Each wale 12 extends from one float 11 to an adjacent float 11 to thereby interconnect the respective floats. It is advantageous to use wooden wales so as to act as a bumper to absorb and cushion collisions between the dock and boats.

Another means for detachably interconnecting the floats 11 may be provided such as tensioning cable or bolt (not shown) extending through a central, longitudinal passage or void in the floats 11. When the cable is tensioned or the bolt tightened, the floats will be secured to one another. In addition, the aforedescribed means of detachably interconnecting the floats 11 may be used in conjunction with one another.

Once the dock 10 has been constructed in the desired configuration, it may be anchored to a piling 14, shown in FIG. 1. The dock 10 is thereby adaptable to rise and fall with the tide. The dock is provided with a collar assembly 15 of any suitable configuration which contains a bracket 16 for receiving therethrough the piling 14. Rollers 17 are interposed between the legs of the bracket 16 and the piling 14 to accommodate the relative motion of the piling 14 with respect to the bracket 16 and thus the dock 10.

Figure 2:
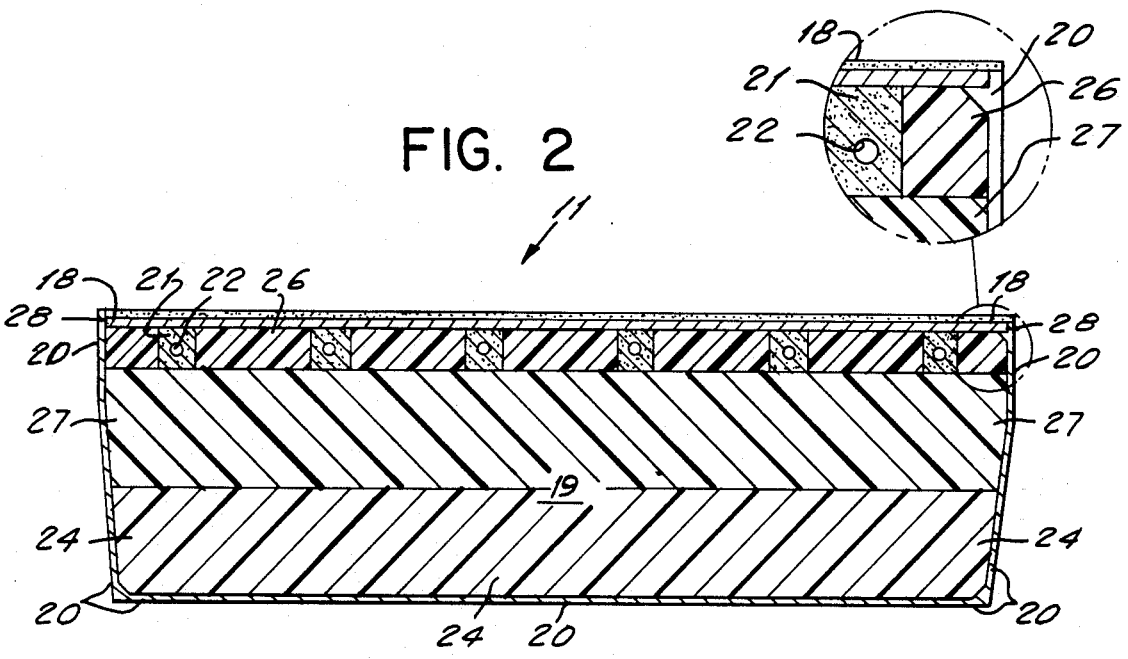
FIG. 2 is a longitudinal sectional view of a marine float according to the present invention taken generally along the line 2—2 in FIG. 1.
Figure 3:
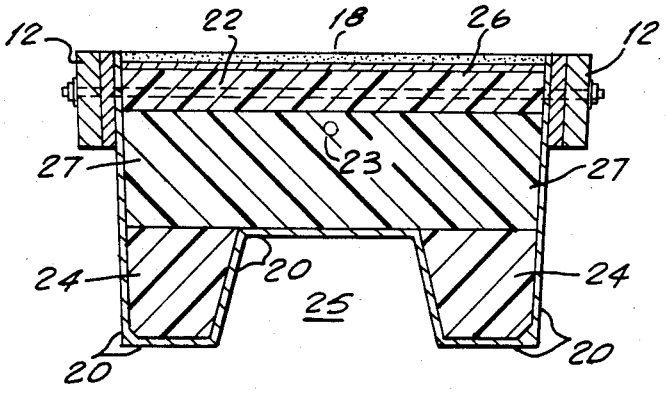
FIG. 3 is a transverse sectional view of a marine float according to the present invention taken generally along the line 3—3 of FIG. 1.
Figure 4:
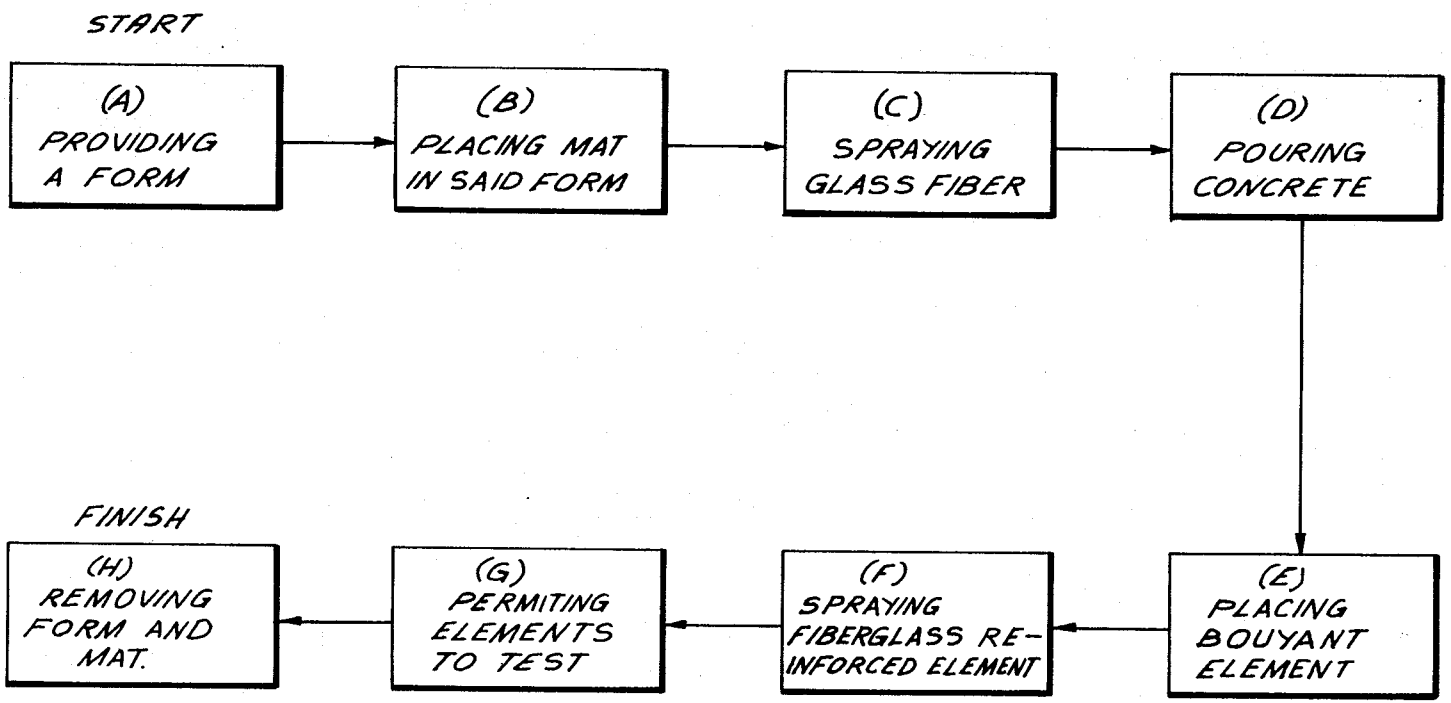
FIG. 4 is a flow chart of the method of fabricating the marine float.

FIGS. 2 and 3 illustrate a float 11 constructed in accordance with the present invention. Generally, each float 11 comprises a top or deck 18 of sprayed glass fiber reinforced concrete supported by a fine aggregate concrete and upon a buoyant element 19 which is covered with a shell 20 of fiberglass reinforced concrete. The deck 11 has a plurality of transverse concrete reinforcing ribs 21 formed integrally with it. Each of the reinforcing ribs 21 has a centrally located, longitudinally extending bore or void 22 formed within it for the location of the through-bolts extending between the respective sides of the float 11 for the attachment of wales 12 in the manner described above. The buoyant element 19 may also have a longitudinally extending bore or void 23, shown in FIG. 3.

Referring to FIG. 3, the buoyant element 19 tapers slightly in the direction of the deck 18 and terminates in two pontoon portions 24 which define a centrally located, longitudinally extending channel 25 disposed in the bottom of the buoyant element. The stability of the float 11 under wave action is enhanced by configuring the pontoons 24 in this fashion.

The shell 20 is advantageously composed of a fiberglass reinforced concrete. Fiberglass reinforced concrete provides a shell of superior strength and flexibility with relatively low weight that can be applied in a relatively thin layer using a spraying process. A preferred type of fiberglass reinforced concrete includes a standard liquid mixture of concrete into which there is uniformly admixed a predetermined quantity of chopped glass fibers. It has been found that a polymer modified fiberglass reinforced concrete using alkaline resistant glass fibers provides increased durability and weather resistance under extreme conditions of moisture and salinity in the environment in which the docks are used.

THE MANUFACTURING PROCESS

The specific construction features of the present invention are perhaps best described by describing the process by which the floats 11 are constructed. The marine float 11 according to the present invention is constructed so as to form a monolithic float. All of the steps in the manufacturing process are performed while the various concrete elements remain encased in plastic and before they have set. By constructing the float in this fashion the concrete elements will set as a unitary whole.

A form (not shown) is provided having a bottom and sides arranged in a generally rectangular configuration. The actual size and dimensions may be varied to meet the desired design requirements of any particular dock configuration. A plasticized polyvinyl chloride texturing mat is placed in the bottom of the form in a second manufacturing step. The texturing mat serves as a means for imparting a given textured surface to the deck 18 of the float 11. For instance, if it is desired that the deck have a simulated wood surface, a texturing mat having reverse surface characteristics will be used as a mold or press to impart a simulated wood surface to the concrete poured into the form.

The manner of constructing the float according to the present invention begins with the deck 18 and proceeds through the bottom of the float 11 by building upon the deck 18 while the float 11 is in an inverted position. A layer of glass fiber reinforced concrete is sprayed into the form over the plasticized polyvinyl chloride mat to a predetermined depth to form the deck 18. Generally, this will be on the order of three-fourth inch depth. As previously indicated a polymer modified fiberglass reinforced concrete containing alkaline resistant glass fiber has proven to be well suited for this purpose. The concrete used for the deck may be integrally colored to conform to the type of textured surface being used for aesthetic purposes. Using the previous example of a simulated wood surface, the color chosen would advantageously impart to the deck a color of wood.

Before the glass fiber reinforced concrete of the deck has set and while it is still in a semi-liquid or plastic state, a layer of standard aggregate concrete 28 is applied on top of the layer forming the deck 18 by a pouring process to a predetermined, uniform depth. This depth will typically be on the order of one-half of an inch.

A plurality of expanded polystyrene blocks 26 are then placed on top of the layer of standard aggregate concrete 28 transversely of the float and uniformly distributed across the surface. These blocks are preferably made of closed-cell block expanded polystyrene with a unit weight of 1.1 pounds per cubic foot. The blocks 26 are best illustrated in FIG. 2. The blocks 26 have a length substantially equal to the width of the form so that they will completely span the width of the float when the float has been constructed. The placement and size of the blocks are such that a space is created between successive blocks 26. A pipe or conduit (not shown) extending the entire length of the space between the blocks 26 and supported therein above the layer of standard aggregate concrete 28 in the sense of the pouring and spraying direction by means associated with the form is placed in one or more of said spaces and extends exteriorly of the form. The spaces between the blocks 26 are then filled with standard aggregate concrete to the level of the blocks 26. Thus it will be seen that transversely extending concrete reinforcing ribs 21 are created which have longitudinally extending tubes or bores 22 defined by the pipes. In the preferred embodiment, once the concrete of the reinforcing ribs 21 have set sufficiently to maintain the shape of the bore 22, the pipe or conduit will be removed to leave a passage through which through-bolts 13 may be located to secure the wales 12 to the sides of the float 11. Alternately, the pipe or conduit may be left in the reinforcing ribs 21.

A main buoyant member 27, preferably a large block of expanded polystyrene, is then positioned on top of the surface defined by the blocks 26 and the concrete reinforcing ribs 21. The main buoyant member 27 is essentially rectangular having a first surface essentially the same dimensions as the deck 18 and a second opposite surface of slightly smaller dimensions such that the float 11 will taper in a direction opposite of the deck 18. Main buoyant members and pontoons are of one piece and are cut to shape.

Pontoon portions 24 are then placed on the main buoyant member 27. The pontoon portions 24 are also advantageously formed of polystyrene and extend longitudinally of the float 11 along the outer edge of the second surface of the main buoyant member 27 to form a continuous side wall. The pontoon portions 24 have a width of somewhat less than ½ of the width of the second surface of the main buoyant member 27 to thereby define a centrally located longitudinally extending groove or channel 25 in what is the bottom portion of the float 11 (see FIG. 3). Providing pontoon portions 24 in this fashion enhances the stability of the float under wave action. The pontoon portions 24 are also tapered in a direction oppositely of the deck so that the float 11 will have a uniform taper along its side walls and a trapezoidally shaped central longitudinal channel.

A layer of fiberglass reinforced concrete is then applied by spraying around the sides and bottom of the float 11 to provide a shell 20 surrounding the buoyant portion 19 of the float 11 and portions 28 and layers 18 and 28. The process is completed while all concrete portions are still plastic and unset. Upon setting of the concrete, a unitary, monolithic float 11 will have been formed and the forms may be removed. The deck 18 and the fiberglass reinforced cement shell 20 will cooperate to enclose the other elements in concrete.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

I claim:

1. A method of fabricating a marine float, comprising:

(a) Providing a form having a generally rectangular configuration;

(b) Placing a texturing mat in said form;

(c) Spraying a layer of glass fiber reinforced concrete into said form over said mat to form a textured deck;

(d) Pouring a layer of standard aggregate concrete over said textured deck;

(e) Placing a buoyant element of expanded polystyrene foam on said layer of fiberglass reinforced cement;

(f) Spraying a layer of fiberglass reinforced cement over the sides and bottom of said buoyant element;

(g) Permitting the concrete elements to set; and (h) Removing the form and textured mat.

2. The method according to claim 1, further including the step of forming a plurality of longitudinally extending pontoons in conjunction with said buoyant element.

3. The method according to claim 2, further including the step of forming a plurality of transversely extending concrete ribs integrally with said textured deck.

* * * * *